US006334785B2

(12) United States Patent
Miwa

(10) Patent No.: US 6,334,785 B2
(45) Date of Patent: Jan. 1, 2002

(54) CONNECTOR SEALING STRUCTURE

(75) Inventor: Takeya Miwa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/801,114

(22) Filed: Mar. 8, 2001

(30) Foreign Application Priority Data

Mar. 10, 2000 (JP) ..... 12-066542

(51) Int. Cl.[7] ..... H01R 13/52
(52) U.S. Cl. ..... 439/272; 439/589
(58) Field of Search ..... 439/272, 273, 439/274, 275, 587, 589

(56) References Cited

U.S. PATENT DOCUMENTS 4,084,875 A * 4/1978 Yamamoto ..... 439/274
4,109,989 A * 8/1978 Snyder, Jr. et al. ..... 439/140
4,116,521 A * 9/1978 Herrmann, Jr. ..... 439/274
4,527,851 A * 7/1985 Gallusser et al. ..... 439/271
4,874,326 A * 10/1989 Marolda, Jr. ..... 439/273
5,295,866 A * 3/1994 Kroger et al. ..... 439/589
6,036,521 A * 3/2000 Tabor et al. ..... 439/272

FOREIGN PATENT DOCUMENTS

GB 1 276 051 6/1972

* cited by examiner

*Primary Examiner*—Tulsidas Patel
(74) *Attorney, Agent, or Firm*—Finnegan, Henderson, Farabow, Garrett & Dunner, L.L.P.

(57) ABSTRACT

A connector sealing structure comprises a first connector, a second connector that fits into the first connector, and a sealing pad inserted between the first and second connectors. The first connector has a first connector housing with a socket, and one or more terminal plugs. Each terminal plug has a pin projecting from the bottom of the socket. The second connector has a second connector housing with a leading face, and one or more terminal jacks inside the connector housing. Each terminal jack receives one of the terminal pins. The sealing pad is positioned between the leading face of the second connector and the bottom of the socket of the first connector. The sealing pad has one or more holes, each receiving one of the pins. A bank, which is made of an elastic material, is formed around the hole and tapers down toward the hole. The holes come into tight contact with the pins when the second connector is fit into the socket and pushed against the sealing pad.

14 Claims, 6 Drawing Sheets

CONNECTOR SEALING STRUCTURE

The present patent application claims the benefit of earlier Japanese Patent Application No. 2000-066542 filed Mar. 10, 2000, the disclosure of which is entirely incorporated herein by reference.

BACKGROUND OF THE INVENTION

1. Field of the Invention

The present invention relates to a connector sealing structure for coupling and sealing a female connector and a male connector. More particularly, the invention relates to an improved connector sealing structure that can effectively prevent leak between adjacent terminal plugs of the connector, and at the same time, shut out water drops from reaching the terminal plugs.

2. Description of the Related Art

In general, a pair of connectors is used to couple electric circuits. Multiple terminal plugs or pins are accommodated in the individual terminal chambers of a connector, which are fit into terminal jacks of a counterpart connector Since leak or short circuit between adjacent terminal plugs has to be precluded from this type of connector, many proposals have been made to prevent leakage of the connectors. An example of the structure for preventing leakage is illustrated in FIG. 1. The connector housing 102 of a connector is furnished with a partition 103 to separate the inner space of the connector housing 102 into terminal chambers. The partition 103 also functions as preventing leak between adjacent terminal plugs (not shown).

Similarly, structures for preventing droplets or dewdrops from entering the terminal chambers of a connector housing have also been proposed. An example of such structures is illustrated in FIG. 2. The entirety of the terminal chambers 105 is surrounded by, for example, rubber packing 106 inside the connector housing 104. If the counterpart connector is fit into the connector housing 104, the packing sticks to the contact surface of the counterpart connector, thereby preventing undesirable droplets from entering the terminal chambers.

However, the leak-prevention connector illustrated in FIG. 1 becomes inevitably large because of the partition 103 provided inside the connector housing 102. The water shut-out connector illustrated in FIG. 2 also becomes inevitably large because the rubber packing 106 is wound around the outer face of the terminal chambers 105 inside the connector housing 104. These structures are against the trend toward and necessity for compactness of connectors.

SUMMARY OF THE INVENTION

Therefore, it is one of the objectives of this invention to provide a compact and reliable connector sealing structure that can prevent leakage between adjacent terminal plugs and, at the same time, prevent water droplets from entering into the terminal chambers.

To achieve this object, a connector sealing structure according to the invention comprises a first connector, a second connector that fits into the first connector, and a sealing pad inserted between the first and second connectors. The first connector has a first connector housing formed into a socket, and one or more terminal plugs. Each terminal plug has a pin projecting from the base of the socket toward the opening of the socket. The second connector has a second connector housing with a leading face, and one or more terminal jacks inside the connector housing. Each of the terminal jacks receives one of the terminal pins. The sealing pad is positioned between the leading face of the second connector and the bottom of the socket of the first connector. The sealing pad has one or more holes for receiving the pins, the holes comes into tight contact with the pins when the second connector is fit into the socket and pushed against the sealing pad.

This structure does not require partitions inside the connector housing or rubber packing wound around the terminal chambers. Accordingly, a compact and reliable connector sealing structure is realized.

The sealing pad is positioned directly on the bottom of the socket, or alternatively, it is positioned just above the bottom of the socket so that a gap is formed between the sealing pad and the bottom of the socket.

Preferably, the sealing pad has holes for receiving the pins, and elastic banks around the holes. The elastic banks are tapered down toward the holes. In this case, the pin of the terminal plug is inserted into the hole of the sealing pad, so that the tip of the pin is positioned lower than the top of the bank. This arrangement can trap water droplets inside the bank, and prevent the water droplets from flowing to the adjacent terminal plugs. Consequently, undesirable leakage or short circuit between adjacent terminal plugs is prevented.

Preferably, the sealing pad is consists of a substrate made of a resin with the bank made of an elastic material. This arrangement guarantees the mechanical strength of the sealing pad, while achieving a reliable sealing ability.

The sealing pad has a flange along the periphery and the flange is in tight contact with the inner wall of the socket of the first connector. This arrangement can shut out water droplets from entering the gap between the first and second connectors.

BRIEF DESCRIPTION OF THE DRAWINGS

Other objects and advantages will be apparent from the following detailed description of the invention in conjunction with the attached drawings, in which.

DETAILED DESCRIPTION OF THE PREFERRED EMBODIMENTS

The preferred embodiment of the connector sealing structure will now be described in detail.

<Overall Structure>

Figure 1:
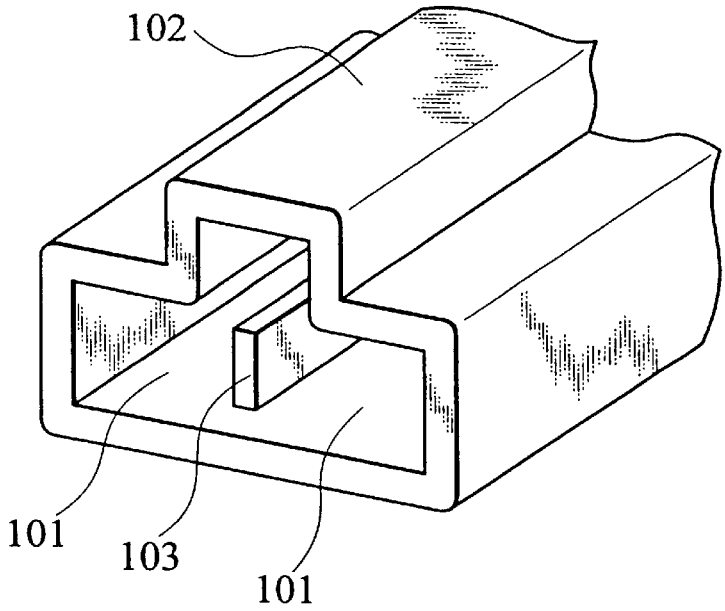
FIG.1 PRIOR ART
FIG. 1 illustrates a conventional connector structure having a partition for preventing leakage between terminal plugs.
Figure 2:
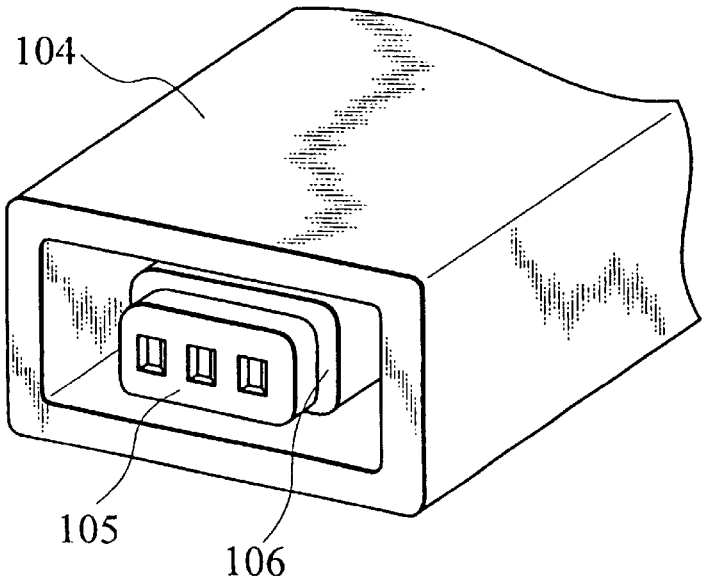
FIG.2 PRIOR ART
FIG. 2 illustrates a conventional connector structure furnished with a rubber packing for preventing water droplets from entering the terminal chambers.
Figure 3:
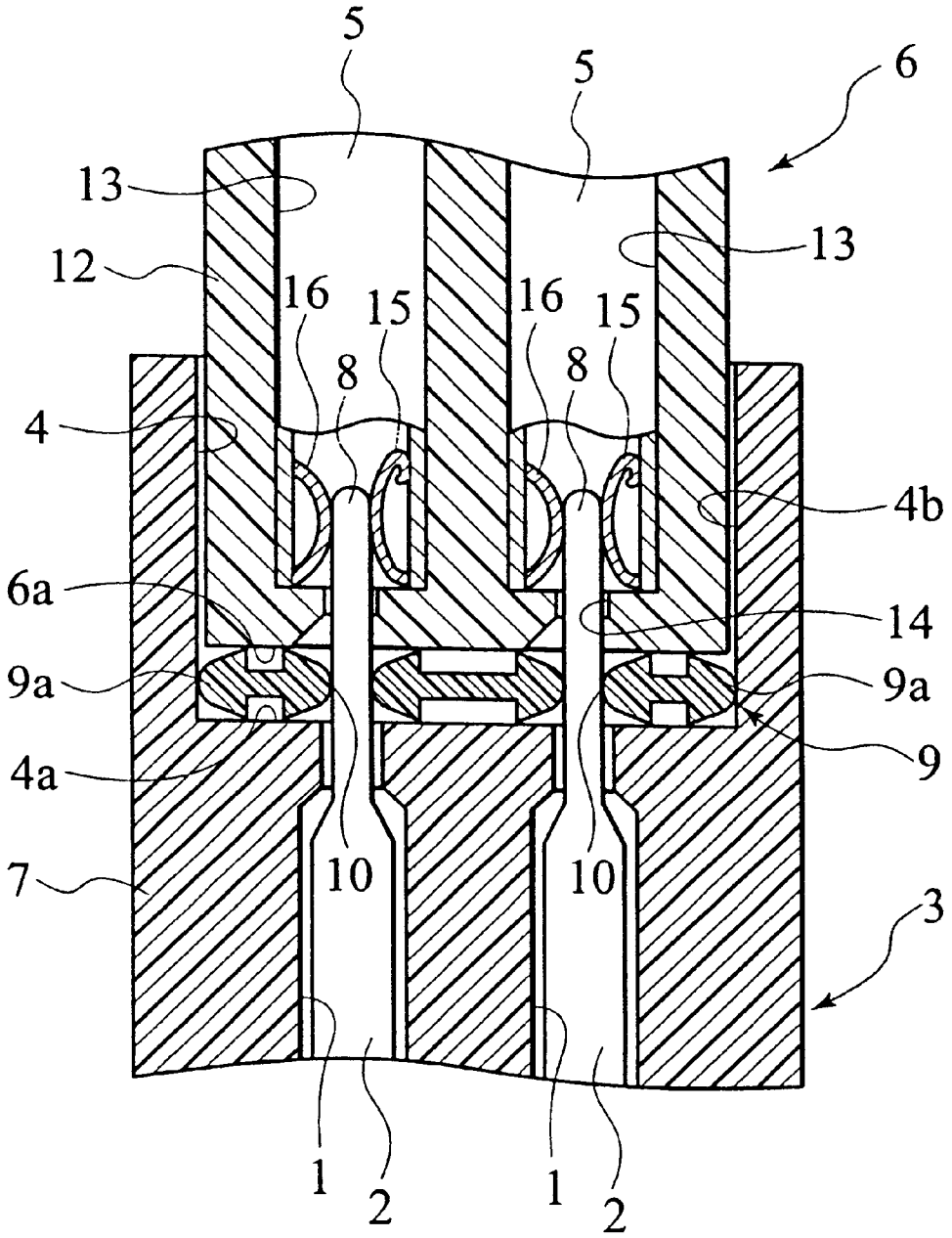
FIG. 3 illustrates a connector sealing structure according to an embodiment of the invention, in which a first connector and a second connector are coupled with each other via tight contact between them.

The connector sealing structure comprises a first connector 3 and a second connector 6 that is fit into the socket 4 of the first connector 3, as shown in FIG. 3. The first connector 3 has one or more terminal plugs 2, each of which is located in the associated chamber 1. The second connector 6 has one or more terminal jacks 5, each of which is located in the associated chamber 13. The terminal plug 2 has a pin 8 that projects from the chamber 1 into the socket 4, and the pin 8 comes into contact with the terminal jacks 5 when the second connector 6 is fit into the first connector 3.

<First Connector>

The first connector 3 has a connector housing 7, into which the second connector 6 is to be inserted. One or more chambers 1 are formed in the housing 7 at a predetermined interval. The terminal chambers 1 of the first connector 3 are referred to as first chambers. The terminal chambers 1 are independent of each other, and each chamber 1 accommodates a terminal plug 2. The terminal plug 2 has a pin 8 that extends from the remote end of the terminal plug 2 and sticks into the socket 4 of the connector housing 7.

Figure 4:
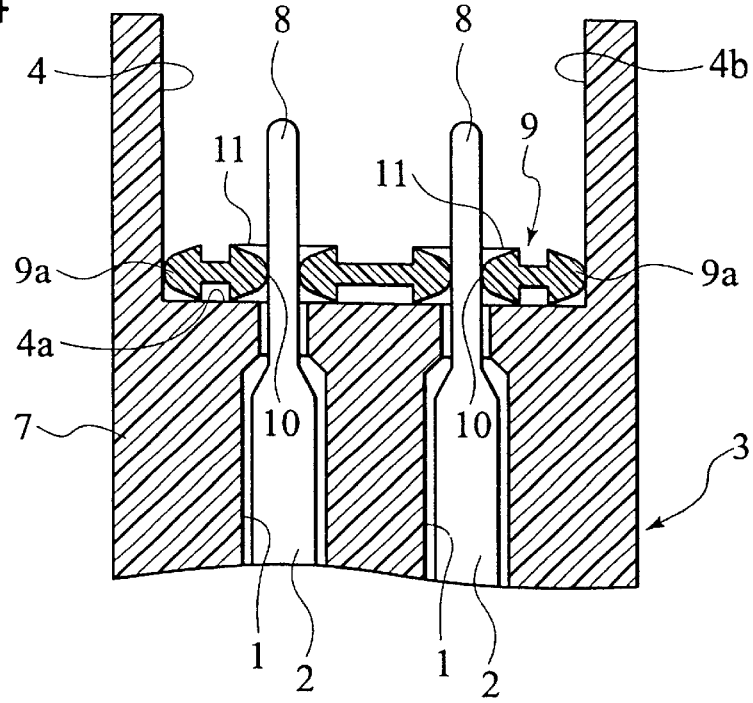
FIG. 4 is a cross-sectional view of the first connector shown in FIG. 3.

The first connector 3 is furnished with a sealing pad 9, which prevents leakage between adjacent terminal plugs 2, and at the same time, precludes undesirable water droplets. The sealing pad 9 may be incorporated into the first connector 3, or alternatively, it may be a separate element and combined with the first connector 3 in a detachable manner. The sealing pad 9 has a contour corresponding to the horizontal cross-section of the socket 4 of the first connector 3. For example, if the socket 4 of the first connector 3 is shaped into a rectangle, the sealing pad 9 will also have a rectangular contour. If the socket 4 of the first connector 3 is cylindrical, then the sealing pad 9 will be a disc. In the example shown in FIGS. 3 and 4, the sealing pad 9 is positioned at the bottom of the socket 4. The sealing pad 9 is made of an insulator having pin-receiving holes 10. The pins 8 of the terminal plugs 2 project into the socket 4 of the first connector 3 via the holes 10 of the sealing pad 9. Preferably, the sealing pad 9 is made of an elastic insulator, such as rubber or urethane. The dimension(s) of the pin-receiving hole 10 are the same as or a slightly smaller than the dimension(s) of the pin 8, so that the pin 8 comes into tight contact with the hole 10.

Figure 10:
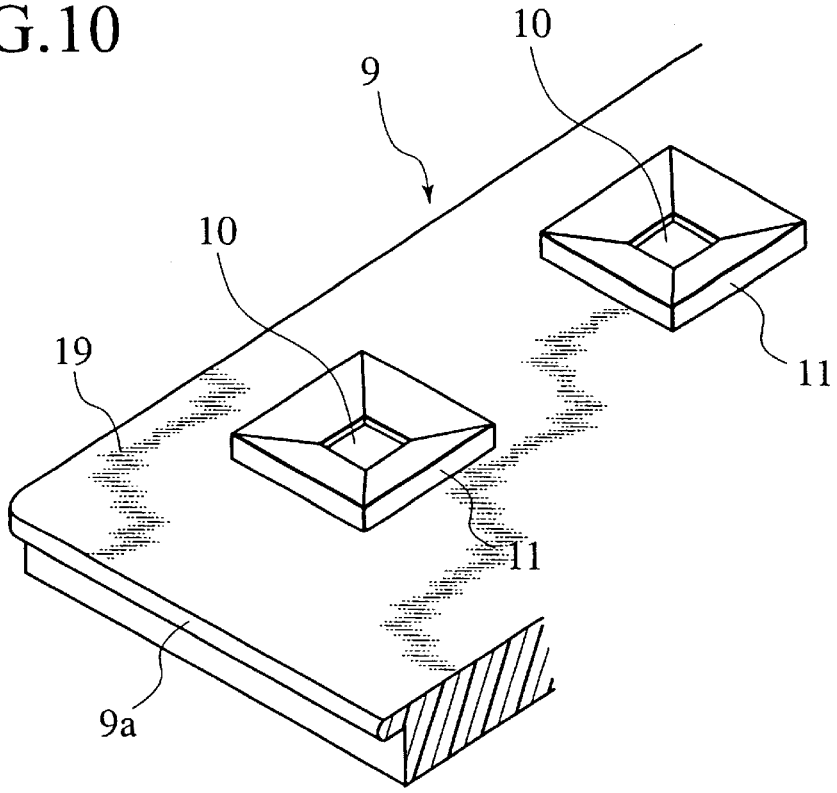
FIG. 10 is a perspective view of the sealing pad shown in FIG. 8, in which the pin-receiving holes formed in a resin pad are surrounded by an elastic materials.
Figure 11:
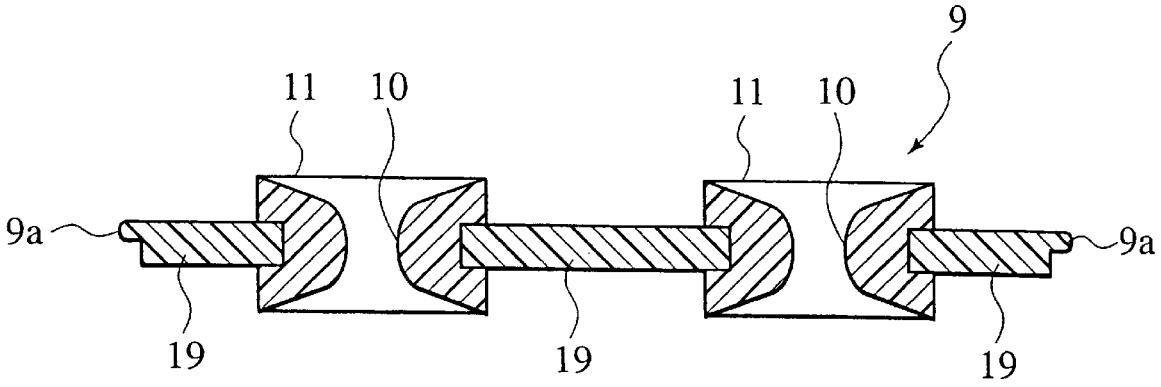
FIG. 11 is an enlarged cross-sectional view of the sealing pad shown in FIG. 8.

A tapered bank 11 is formed around each pin-receiving hole 10, as shown in FIG. 10. The bank 11 is made thicker than the remaining portion of the sealing pad 9. The pin-receiving hole 10 is positioned in the middle of the bank 11 that is tapered down toward the hole 10.

The periphery of the sealing pad 9 comes into tight contact with the inner wall 4*b* of the socket 4 of the first connector, and functions as a seal for preventing undesirable water droplets from penetrating into the terminal chambers 1. To this end, the cross-section of the periphery 9*a* is arched in this example.

With this arrangement, the sealing pad 9 comes into tight contact both with the inner wall of the socket 4 and the pins 8 of the terminal plug 2, which can prevent leaks between adjacent terminal plugs, and at the same time, preclude water droplets.

<Second Connector>

The second connector 6 has a connector housing 12, in which one or more chambers 13 are formed. The chambers 13 of the second connector 6 are referred to as second chambers. The second chambers 13 are independent of each other, and each chamber 13 accommodates a terminal jack 5. The second connector 6 is fit into the socket 4 of the first connector 3, and has holes 14 on its leading face 6*a*. The pins 8 of the first connector 3 are inserted into the holes 14 of the second connector 6 when the first and second connectors 3 and 6 are coupled with each other.

The terminal jack 5 of the second connector 6 has an elastic contact 15 and an elastic receiver 16 in its inner space. The elastic contact 15 and the elastic receiver 16 cooperate to hold the pin 8 of the terminal plug 2 of the first connector 3 when the pin 8 is inserted into the terminal jack 5.

<Connection of Two Connectors>

In the preferred embodiment, a separate sealing pad 9 is combined with the first connector 3 prior to coupling the first and second connectors 3 and 6.

First, the pin 8 of the terminal plug 2 of the first connector 3 is inserted into the pin-receiving hole 10 of the sealing pad 9. The sealing pad 9 is slid down toward the bottom 4*a* of the socket 4 of the first connector 3. In the example shown in FIGS. 3 and 4, the sealing pad 9 is slid down until it comes into direct contact with the bottom face 4*a* of the socket 4.

Then, the second connector 6 is fit into the socket 4 of the first connector 3 until the leading face 6*a* of the second connector 6 comes into contact with the sealing pad 9. The second connector 6 is further pushed against the sealing pad 9. Because the sealing pad 9 is made of an elastic insulator, it is pressed by the external (pushing) force, and expands in the outward directions.

Under the stress, the periphery of the sealing pad 9 comes into tight contact with the inner wall 4*b* of the socket 4. Consequently, water droplets are shut out from entering the terminal chamber 1 of the first connector 3 through the gap between the outer face of the second connector 6 and the inner wall 4*b* of the first connector 3.

Figure 5:
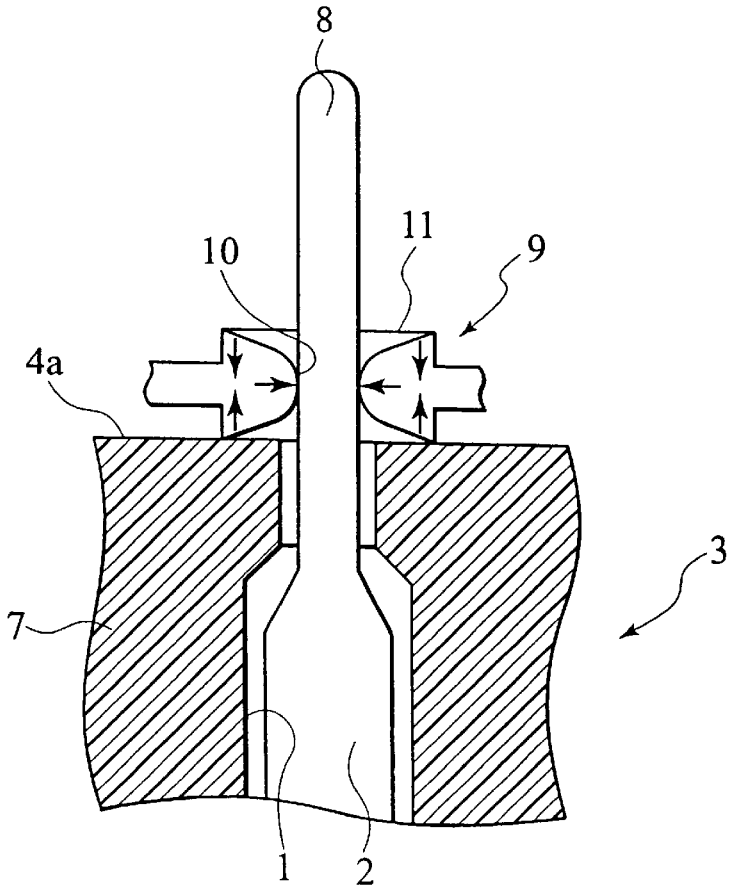
FIG. 5 illustrates in an enlarged view how the load is applied to the pin-receiving holes of the sealing pad when the first connector is coupled to the second connector.

FIG. 5 illustrates how the force is applied around the pin-receiving hole 10 of the sealing pad 9. As has been mentioned above, the bank 11 is made thicker than the remaining portion of the sealing pad 9. When the second connector 6 is fit into and pushed against the sealing pad 9, an external force is applied to the bank 11 in the thickness direction, and the stress is generated as indicated by the arrows. A horizontal force is also generated in the bank 11, which causes the hole 10 to narrow. As a result, the hole 10 comes into tight contact with the pin 8, and the gap around the pin 8 is sealed up. This arrangement effectively precludes water droplets from entering the terminal chamber 1.

The sealing pad 9, which is made of an elastic insulator (e.g., rubber), physically and electrically insulates terminal plugs 2 from each other. Accordingly, undesirable leakage or short circuit between adjacent terminal plugs 2 can be prevented.

This, the sealing pad 9 can achieve both leak prevention effect and water shutout effect, while keeping the connector compact.

<First Modification>

Figure 6:
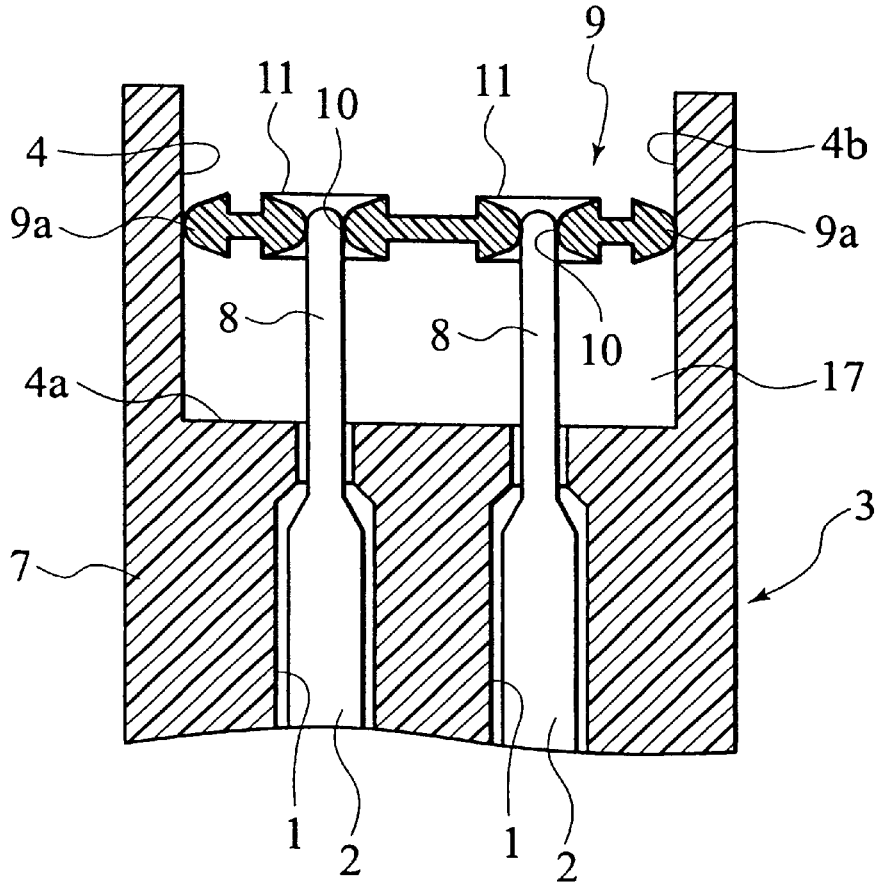
FIG. 6 illustrates a modification of the first connector, in which the sealing pad receives the terminal pins near their tips.
Figure 7:
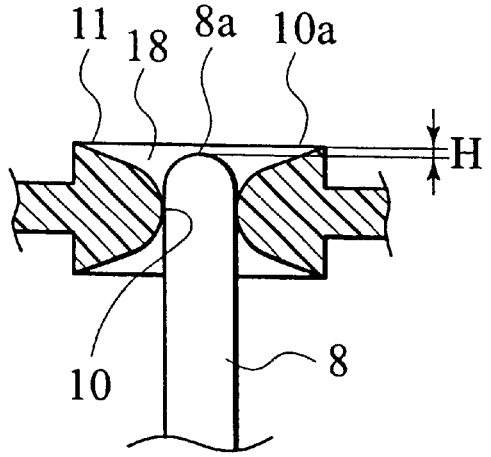
FIG. 7 illustrates in an enlarged view the tip of the terminal pin of the first connector.

FIGS. 6 and 7 illustrates a modification of the first connector 3. In this example, the sealing pad 9 is positioned above the bottom 4*a* of the socket 4 of the first connector 3, so that the pin-receiving hole 10 holds the tip of the pin 8 of the terminal plug 2. In the preferred example, the tip 8*a* of the pin 8 is positioned slightly below the highest point 10*a* of the bank 11, so that the tip 8*a* of the pin 8 does not project above the bank 11, as shown in FIG. 7. Because the periphery 9*a* of the sealing pad 9 is in tight contact with the inner wall 4*b* of the socket 4, and because the hole 10 is in tight contact with the pin 8, the sealing pad 9 is supported above the bottom 4*a* by the friction.

In this arrangement, there is a gap 17 between the sealing pad 9 and the bottom 4*a* of the socket 4, as illustrated in FIG. 6. The tight contact between the sealing pad 9 and the socket 4, and between the hole 10 and the pin 8, can preclude water droplets from entering the gap 17. If the sealing pad 9 is incorporated in the first connector 3, the sealing pad 9 functions as a cap, and the terminal plugs 2 accommodated in the chambers 1 are protected from water droplet before the second connector 6 is connected to the first connector 3.

Because the tip 8*a* of the pin 8 is positioned slightly below the top plane of the bank 11, a water droplet that happens to reach the top face of the sealing pad 9 is trapped in the tapered socket. The water droplet is hindered from flowing on the surface of the sealing pad 9 toward the adjacent pin 8. Even if the water droplets start flowing along the top surface of the sealing pad 9, they can hardly reach the adjacent pin 8 because the total distance from the root of one pin 8 to the next pin 8 is sufficiently long. This arrangement can effectively prevent leak between adjacent terminal plugs 2.

<Second Modification>

Figure 8:
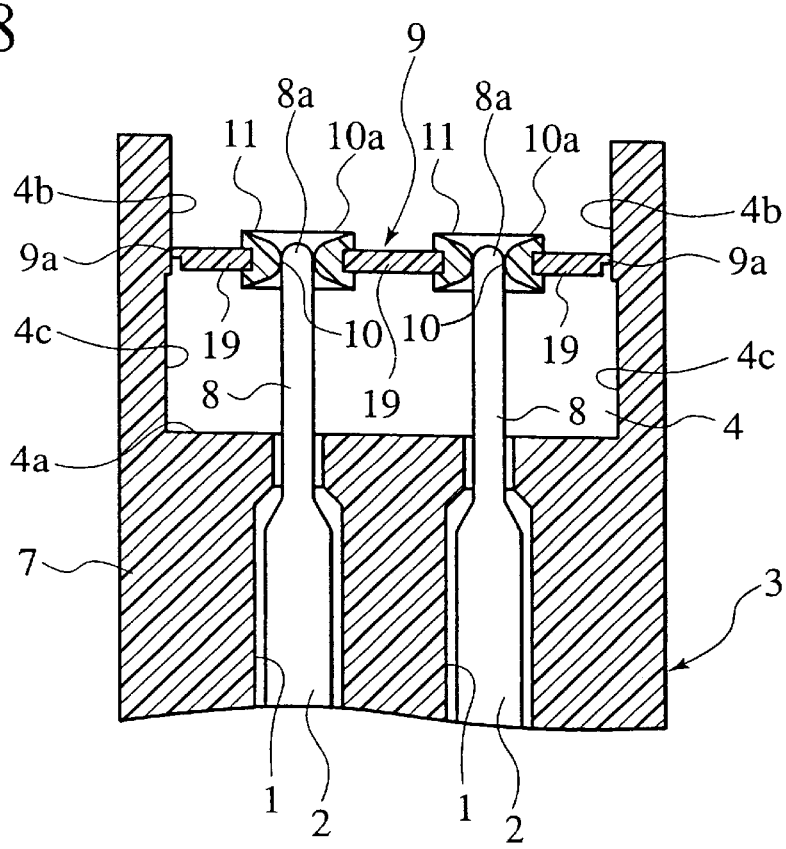
FIG. 8 illustrates another modification of the first connector, in which the sealing pad is made of a resin, with the tapered bank around the pin-receiving holes made of an elastic material.
Figure 9:
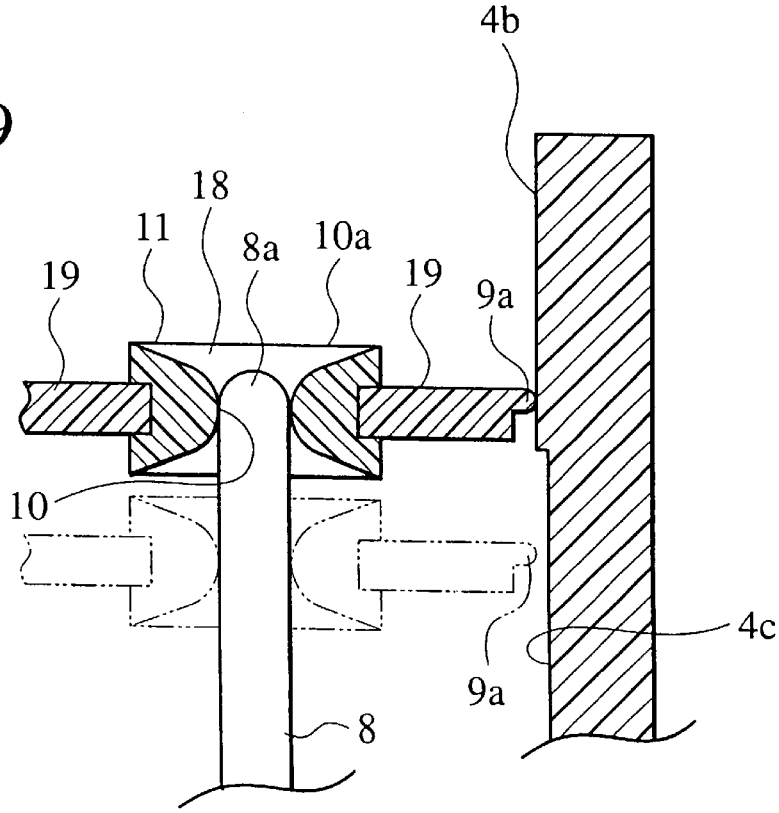
FIG. 9 is an enlarged view of the sealing pad shown in FIG. 8, in which the periphery of the sealing pad comes into tight contact with the inner wall of the socket of the first connector.

FIGS. 8 through 11 illustrates a second modification of the sealing pad 9. In the first modification, the sealing pad 9 is made of a single material, that is, an elastic insulator. In the second modification, the sealing pad 9 is made of two different materials. The bank 11 surrounding the hole 10 is made of an elastic material, and the remaining portion or the substrate 19 is made of a resin. Preferably, the sealing 19 shown in FIG. 8 is formed monolithically by dichromatic molding. The bank 11 is again tapered down toward the hole 10 located in the middle of the bank 11. The bank 11 is thicker than the substrate 19 so as to be compressed by an external force when the second connector 9 is fitted and pushed into the socket 4 of the first connector 3.

In the second modification, the sealing pad 9 has a flange along the periphery 9*a*. The cross-section of the flange 9*a* is arched, as is clearly illustrated in FIG. 9. In the pre-sealing state, in which the second connector 6 has not been fully inserted into the first connector 3, the flange 9*a* is already in tight contact with the inner wall 4*b* of the socket 4. This means that the sealing pad 9 functions as a cap for protecting the first connector from undesirable water droplets or dust. The friction between the flange 9*a* and the inner wall 4*b* allows the sealing pad 9 to be held firmly above the bottom face 4*a* of the socket 4. Water droplets are shut out from entering the terminal chamber 1 even before the second connector 6 is fully coupled with the first connector 3. The sealing pad 9 may be a separate element from and connected with the first connector 3 in a detachable manner, or alternatively, it may be incorporated into first connector 3.

As in the first modification, the tip 8*a* of the pin 8 is positioned slightly below the top 10*a* of the bank 11 so as not to project out of the bank 11. The banks 11 traps water droplets that happen to reach the top surface of the sealing pad 9, and prevent the droplets from flowing and reaching to the adjacent pin 8, as described in the first modification.

The connector housing 7 of the first connector 3 has an indent in its inner wall 4*b* at and near the position at which the flange 9*a* of the sealing pad 9 is supported. In other words, the socket 4 of the connector housing 7 becomes broader from directly below where the sealing pad is supported down to the bottom 4*a*, as is indicated by the numerical reference 4*c* in FIGS. 8 and 9. The dimensions of the broader region 4*c* can be selected as preferred as long as the flange 9*a* of the sealing pad 9 does not make catch with the inner wall of the broader region 4*c*.

In coupling the second connector 6 with the first connector 3 via the sealing pad 9, the second connector 6 is fit into the socket 4 of the first connector 3, and pushed toward the sealing pad 9. The second connector 6 is further pushed even after it reaches the sealing pad 9 against the friction between the flange 9*a* of the sealing pad 9 and the inner wall (or the indent) 4*b* of the socket 4. When the sealing pad is pushed down to the broader region 4*c*, the sealing pad 9 is disengaged from and the inner wall 4*b*, as is illustrated by the ghost line in FIG. 9.

Consequently, the sealing pad 9 is smoothly pushed toward the bottom 4*a* of the socket 4. Although stress is applied to the sealing pad 9 during the insertion of the second connector 6, the sealing pad 9 does not deform because its substrate 19 is made of a resin and has an adequate mechanical strength.

The stress is also applied to the elastic bank 11. The elastic bank 11 deforms due to the stress in the directions indicated by the arrows in FIG. 5. Accordingly, the hole 10 narrows to tightly hold the pin 8, while keeping the substrate 9 straight. The tight contact between the pin 8 and the hole 10 precludes water droplets from entering the terminal chamber 1, and at the same time, leakage between adjacent terminal plugs can be prevented because the terminal plugs are physically and electrically insulated from each other.

As has been described above, the sealing pad positioned between the bottom of the connector housing of the first connector and the leading face of the second connector effectively insulate adjacent terminal plugs from each other, thereby preventing leak or short circuit between adjacent terminal plugs. At the same time, the sealing pad shuts out undesirable water droplets.

The sealing pad allows the entire connector structure to be kept compact because it is simply inserted between the first and second connectors, while precluding leakage and water droplets in a reliable manner.

The external force applied to the sealing pad during the insertion of the second connector brings the holes of the sealing pad into tight contact with the pins of the terminal plugs, and at the same time, allows the periphery of the sealing pad to come into tight contact with the inner wall of the connector housing.

The tapered bank surrounding the pin-receiving hole traps water droplets so as not to allow the water droplet to reach the adjacent terminal plugs.

Although the invention has been described based on the preferred embodiment, the invention is not limited to the example, and there are many changes and substitutions possible without departing from the scope of the invention.

What is claimed is:

1. A connector sealing structure comprising:

a first connector having a first connector housing with a socket and one or more terminal plugs, each terminal plug having a pin projecting into the socket from its bottom surface;

a second connector having a second connector housing with a leading face and one or more terminal jacks inside the connector housing, each terminal jack receiving one of the terminal pins;

a sealing pad positioned between the leading face of the second connector and the bottom of the socket of the first connector, the sealing pad having one or more holes for receiving the pins, the holes coming into tight contact with the pins when the second connector is fit into the socket and pushed against the sealing pad; and an elastic bank being provided adjacent each of the holes so as to be tapered down toward the hole.

2. The connector sealing structure of claim 1, wherein the sealing pad is positioned directly on the bottom of the socket.

3. The connector sealing structure of claim 1, wherein the sealing pad is positioned above the bottom of the socket so that a gap is formed between the sealing pad and the bottom of the socket.

4. The connector sealing structure of claim 1, wherein the sealing pad, including the bank, is made of an elastic insulator, and a periphery of the sealing pad is in tight contact with an inner wall of the socket of the first connector.

5. The connector sealing structure of claim 1, wherein the sealing pad consists of a substrate that is made of resin, and banks that are made of an elastic material and formed around the holes.

6. The connector sealing structure of claim 1, wherein the tip of the pin is positioned lower than the top of the bank.

7. A connector sealing structure comprising:

first connector having a first connector housing with a socket and one or more terminal plugs, each terminal plug having a pin projecting into the socket from its bottom surface, the socket having an indent along its inner wall so that the socket becomes slightly broader along the indent;

a second connector having a second connector housing with a leading face and one or more terminal jacks inside the connector housing, each terminal jack receiving one of the terminal pins; and a sealing pad positioned between the leading face of the second connector and the bottom of the socket of the first connector, the sealing pad having one or more holes for receiving the pins, the holes coming into tight contact with the pins when the second connector is fit into the socket and pushed against the sealing pad, the sealing pad also having a flange along its periphery, the flange being in tight contact with the inner wall of the socket of the first connector.

8. The connector sealing structure of claim 7, wherein the sealing pad is positioned directly on the bottom of the socket.

9. The connector sealing structure of claim 7, wherein the sealing pad is positioned above the bottom of the socket so that a gap is formed between the sealing pad and the bottom of the socket.

10. The connector sealing structure of claim 7, wherein the sealing pad further has elastic banks around the holes, the elastic banks being tapered down toward the associated hole.

11. A connector sealing structure comprising:

a first connector having a first connector housing, one or more terminal plugs, and a sealing pad with one or more holes, the first connector housing having a socket with a bottom and an inner wall, each terminal plug having a pin that projects into the socket from its bottom and which is inserted into the hole of the sealing pad; and a second connector having a second connector housing with a leading face and one or more terminal jacks inside the second connector housing, each terminal jack receiving one of the terminal pins;

wherein the holes of the sealing pad come into tight contact with the pins when the second connector is inserted into the socket of the first connector and the leading face of the second connector is pushed against the sealing pad;

wherein the sealing pad has a plurality of bank and each of the plurality of banks is adjacent and tapered down toward one of the holes; and the plurality of banks are made of an elastic material.

12. The connector sealing structure of claim 11, wherein the sealing pad is positioned directly on the bottom of the socket of the first connector housing.

13. The connector sealing structure of claim 11, wherein the sealing pad is positioned above the bottom of the socket of the first connector housing.

14. The connector sealing structure of claim 11, wherein the sealing pad is placed in the socket of the first connector housing in a detachable manner.

* * * * *

UNITED STATES PATENT AND TRADEMARK OFFICE

CERTIFICATE OF CORRECTION

PATENT NO. : 6,334,785 B2
DATED : January 1, 2002
INVENTOR(S) : Takeya Miwa

It is certified that error appears in the above-identified patent and that said Letters Patent is hereby corrected as shown below:

Column 8,
Line 30, “plurality of bank” should read -- plurality of banks --.

Signed and Sealed this

Twenty-third Day of July, 2002

*Attest:*

*Attesting Officer*

JAMES E. ROGAN
*Director of the United States Patent and Trademark Office*